US006533192B1

(12) United States Patent
Weiand

(10) Patent No.: US 6,533,192 B1
(45) **Date of Patent: *Mar. 18, 2003**

(54) FLUID TRANSFER PUMP WASH-OUT APPARATUS AND METHOD

(76) Inventor: Ronnie Joe Weiand, 1637 Orchard Dr. Apt. 11, Placentia, CA (US) 92870

( * ) Notice: Subject to any disclaimer, the term of this patent is extended or adjusted under 35 U.S.C. 154(b) by 0 days.

This patent is subject to a terminal disclaimer.

(21) Appl. No.: 09/894,209

(22) Filed: Jun. 27, 2001

Related U.S. Application Data

(63) Continuation-in-part of application No. 09/209,550, filed on Dec. 11, 1998, now Pat. No. 6,318,644, which is a continuation-in-part of application No. 08/857,384, filed on May 15, 1997, now abandoned.

(51) Int. Cl.[7] ..... B05B 15/02

(52) U.S. Cl. ..... 239/112; 239/113; 239/304; 239/305

(58) Field of Search ..... 239/112, 113, 239/304, 305; 137/240, 606; 417/503, 510

(56) References Cited

U.S. PATENT DOCUMENTS 6,318,644 B1 * 11/2001 Weiand ..... 239/112

* cited by examiner

*Primary Examiner*—Robin O. Evans
(74) *Attorney, Agent, or Firm*—Dergosits & Noah LLP

(57) ABSTRACT

A fluid transfer pump wash-out apparatus is provided to facilitate cleaning of fluid transfer pump system components. The wash-out apparatus is adapted for temporary or permanent insertion between at least one pump liquid source pick-up point and a pump intake. The body of the wash-out apparatus is preferably adapted for connection in a pick-up hose assembly. The wash-out apparatus body is joined to a flow valve that is coupled to an intake coupler. The flow valve is operable to control the flow of fluid from the first pick-up hose into the body. The intake coupler is in turn coupled to a first pick-up hose that transports fluid from the liquid source pick-up point to the wash-out apparatus. An output coupler joined to the output end of the body is coupled to a second pick-up hose for connection to the fluid transfer pump assembly. A wash-out hook-up is provided to couple the body of the wash-out apparatus to a source of cleaning fluid. A wash-out hook-up valve is provided to control the flow of fluid between the body and the wash-out hook-up. The flow valve and wash-out hook-up can be arranged to permit the fluid transfer pump to intake fluid from the liquid source pick-up point. Alternatively, the flow valve and wash-out hook-up can be arranged to permit cleaning fluid to pass through and cleanse all parts of the wash-out apparatus. The wash-out apparatus can be configured as, or for use with, a fluid transfer manifold for multiple containers.

3 Claims, 6 Drawing Sheets

FLUID TRANSFER PUMP WASH-OUT APPARATUS AND METHOD

RELATED APPLICATION DATA

This application is a continuation in part application of application Ser. No. 09/209,550, now U.S. Pat. No. 6,318,644, issued Nov. 20, 2001, filed Dec. 11, 1998, which was a continuation in part application of application Ser. No. 08/857,384, filed on May 15, 1997 now abandoned. The contents of these applications and patent are hereby incorporated by reference in their entirety.

BACKGROUND OF THE INVENTION

1. Field of the Invention

The present invention relates to fluid transfer pumps. More specifically, the present invention relates to an apparatus and method for supplying fluid to a fluid transfer pump while facilitating the cleaning of the pump.

2. Description of Related Art

Fluid transfer pumps are commonly used to transfer a controlled stream of fluids from a fluid source to an outlet of the transfer pump system. A conventional fluid transfer pump has an inlet for receiving the fluid and an outlet for ejecting the fluid, typically under force. An example of a commonly-used fluid transfer pump is an airless spray painting system. A typical prior art airless spray painting system is operated under pressure. FIG. 1 is a side view of an airless spray painting system 10 according to the prior art.

In the Figure, a pump motor 12 generates the suction force used to draw in the fluid (in this case, paint) from a liquid source pick-up point, typically a container 18. The standard-sized paint supply of such prior art systems is a single one gallon paint can, typically used by non-professional painters, and a single five gallon paint bucket, typically used by professional painters.

The paint is drawn through an inlet fluid conduit such as a pick-up hose assembly 16 and into the pump intake 14. The paint is then urged into an outlet hose 20 that is joined to a spray gun 22, where the paint can be ejected from the system as a spray. The pump can use negative pressure (suction) to draw the fluid into the system and towards the outlet. Alternatively, back pressure can be used to propel the fluid forward through the outlet.

Air leakage to and from the pump assembly 24 reduces the pressure within the assembly. This reduction in pressure can cause a significant diminution in pumping force. To minimize the likelihood of air leakage and the resulting reduction in internal pressure, pressurized fluid transfer pumps are frequently constructed such that they cannot be readily disassembled.

However, a pump that cannot be disassembled is not easily cleaned. Such pump is generally cleaned by forcing a cleansing fluid, such as water or a solvent, through the pump assembly. This cleansing process can be time consuming, inefficient, and detrimental to the environment.

For example, the process usually employed to clean an airless spray painting system is for the painter to first wash the paint out of one or more paint containers. The painter then fills the paint containers with water and carries them to the location of the spray painting system. The inlet fluid conduit is inserted into the water and the spray pump motor is started. Water is pumped through the pump assembly and fluid conduits and ejected through the spray gun until the system is clean. This process must frequently be repeated to thoroughly clean the paint from the system.

The paint-and-water solution that is ejected from the system can be toxic and hazardous to the environment. The painter must either carefully collect this solution in containers for proper waste disposal, or risk fines and potential environmental damage by discarding the solution on the ground or into a drainage system.

An additional drawback to the prior art airless spray painting systems is that numerous delays occur when an exhausted paint supply is replaced with a new supply. Because commercial spray guns efficiently dispense paint, a five gallon paint bucket can typically be depleted and require replacement in approximately 8 to 10 minutes.

Perhaps an even more serious disadvantage is the damage caused to the spray pump between the time the paint is depleted from the paint bucket and the time the spray pump is shut off. Air has a lower viscosity than paint and therefore, the pump motor operates at much higher speeds when drawing air than when drawing paint. Such higher operating speeds can reduce the life expectancy of the motor.

One known solution to this problem is to provide a paint supply that is larger than the standard one gallon can or five gallon bucket. Unfortunately, such larger paint supplies are difficult to transport and to use, especially for the commercial painter. Furthermore, the significant commercial advantages to paint manufacturers and distributors of using standard-sized containers would tend to outweigh any benefits of using larger containers. An additional disadvantage of using larger paint containers is the likelihood of waste by non-professional painters, and the greater costs inherent thereto.

It would therefore be an advantage to provide a method and apparatus for rapidly and efficiently cleaning a fluid transfer pump, such as an airless spray painting system. It would be another advantage if such apparatus provided painters with a larger supply of paint while maintaining the use of standardized one gallon cans and five gallon buckets. It would be a further advantage if the apparatus minimized the likelihood of environmental exposure to any toxic materials cleaned from the pump. It would be yet another advantage if the apparatus could be implemented as an integral part of a fluid transfer pump, or as a removable addition thereto.

SUMMARY OF THE INVENTION

The present invention is a wash-out apparatus that can be used to facilitate cleaning of fluid transfer pump system components, and a method for use thereof. The fluid transfer pump wash-out apparatus is adapted for insertion between the pump liquid source pick-up point and the pump intake. The present invention can be provided as an integral part of the fluid transfer pump system, or can alternatively be provided as a separate unit for temporary or permanent incorporation into an existing fluid transfer pump system.

In the preferred embodiment of the present invention, the body of the wash-out apparatus is adapted for connection in a pick-up hose assembly. The wash-out apparatus body is joined at the intake end to a flow valve that is coupled to a first pick-up hose that transports fluid such as paint from a container to the wash-out apparatus. The flow valve is operable to control the flow of fluid such as paint from the first pick-up hose into the body of the wash-out apparatus.

The wash-out apparatus body is also joined at an output end to a second pick-up hose that is connected to the intake of the pump assembly. A wash-out hook-up is provided to couple the body of the wash-out apparatus to a source of cleaning fluid, such as a garden hose or solvent container. A wash-out hook-up valve is provided to control the flow of fluid between the body of the wash-out apparatus and the wash-out hook-up. The flow valve and wash-out hook-up can be arranged to permit the fluid transfer pump to intake fluid from the liquid source pick-up point, for example paint from a container. Alternatively, the flow valve and wash-out hook-up can be arranged to permit cleaning fluid to pass through and cleanse all parts of the wash-out apparatus.

The wash-out apparatus can be configured to directly connect the wash-out apparatus to the pump assembly or to the liquid source pick-up point. In one embodiment of the present invention, the wash-out apparatus is configured as a fluid transfer manifold for multiple containers. In this embodiment, the wash-out apparatus body includes a junction box with a plurality of intake couplers, each of which can be joined to a pick-up hose. A common outlet coupler is connected to the pump assembly, for example, through a second pick-up hose. A filter can be used to separate undesirable materials from the paint delivered to the spray gun. In an alternative embodiment, the present invention is adapted for connection to a separate fluid transfer manifold to permit the use of fluid from a plurality of pick-up containers.

DETAILED DESCRIPTION OF THE INVENTION

The present invention is a fluid transfer pump wash-out apparatus that facilitates the cleaning of fluid transfer pump system components, and a method for use thereof. The fluid transfer pump wash-out apparatus can be provided as an integral part of the fluid transfer pump system, or can alternatively be provided as a separate unit for temporary or permanent incorporation into an existing fluid transfer pump system. The present invention can be used with one or more filters to remove undesirable substances from the fluid.

The present invention is described herein with respect to an airless spray painting system. However, the present invention is equally adapted for use with any appropriate fluid transfer pump system. For example, the present invention can be used with paint rollers, paint brushes, spray guns for washing windows, houses, automobiles, or other machinery, and spray guns for dispensing fertilizer or insecticide. Therefore, the description provided herein is for exemplary purposes only and is not intended to limit in any way the scope and application of the present invention.

Figure 1:
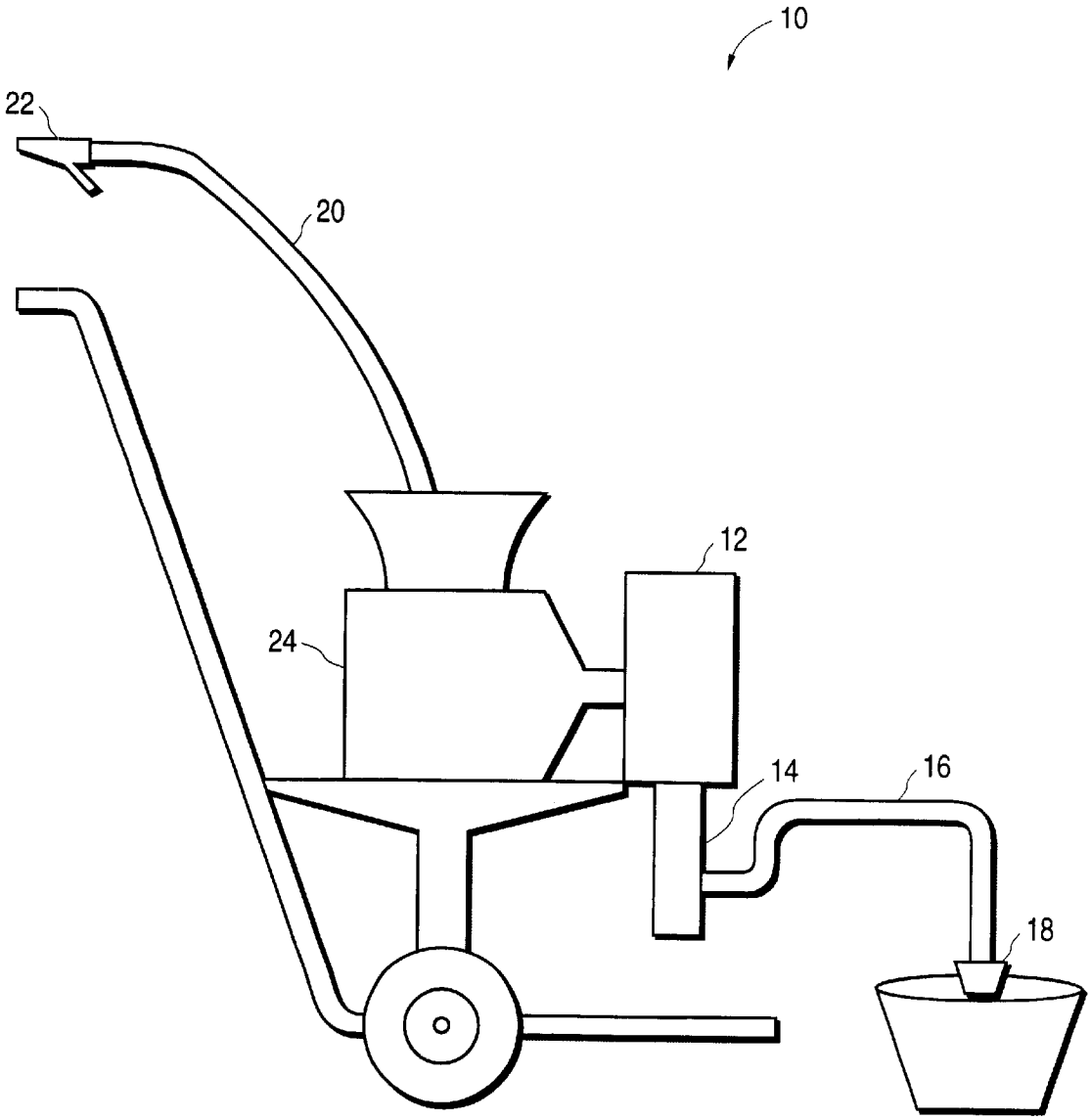
FIG.1 (PRIOR ART)
FIG. 1 illustrates a side view of an airless spray painting system, according to the prior art.
Figure 2:
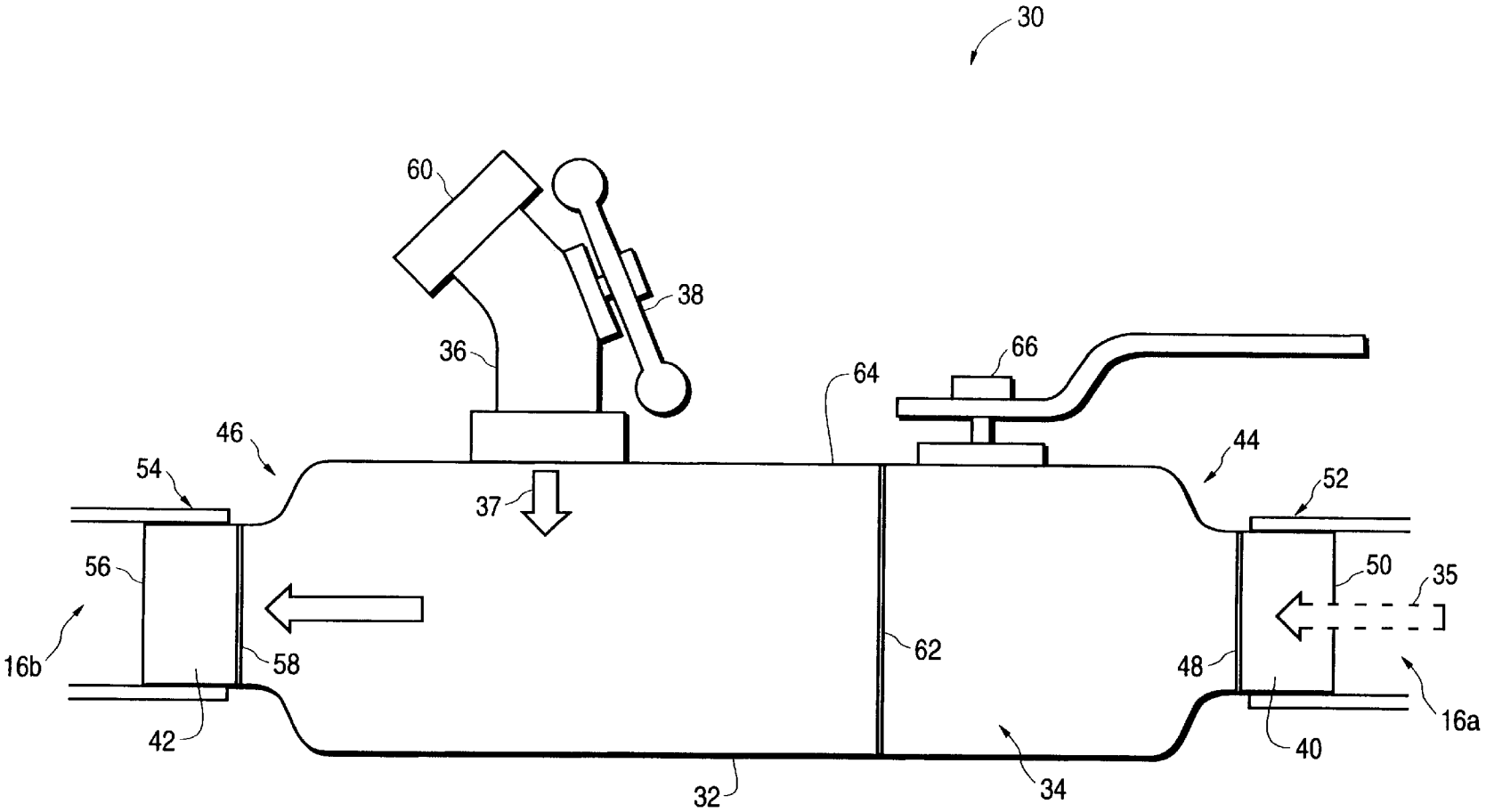
FIG. 2 illustrates a side sectional view of a fluid transfer pump wash-out apparatus, according to a preferred embodiment of the present invention.

FIG. 2 is a side sectional view of a fluid transfer pump wash-out apparatus 30 according to a preferred embodiment of the present invention. The wash-out apparatus is adapted for insertion between the pump liquid source pick-up point and the pump intake. In the preferred embodiment of the present invention, the body 32 of the wash-out apparatus is adapted for connection in the pick-up hose assembly (See FIG. 1, Element 16). A first pick-up hose 16*a* is used to transport paint from a container (not shown) to the wash-out apparatus.

A flow valve 34 is joined to the body of the wash-out apparatus. In the preferred embodiment of the present invention, the flow valve is provided with threading (not shown) at an output end 62 for screwing into complementarily threading in an intake end 64 of the body. However, any other suitable means of attachment can also be used.

In the preferred embodiment of the invention, a first end 48 of an intake coupler 40 is adapted to be removably joined to an intake end 44 of the flow valve. A second end 50 of the intake coupler is adapted to be removably joined to an output end 52 of the first pick-up hose 16*a*. In alternative embodiments of the present invention, the intake coupler is adapted to be permanently joined to either or both of the first pick-up hose and the flow valve, for example, using a glue or epoxy.

The body is similarly provided with an output coupler 42 for coupling the wash-out apparatus to a second pick-up hose 16*b*. A first end 58 of the output coupler is adapted to be removably joined to an output end 46 of the body of the wash-out apparatus. A second end 56 of the output coupler is adapted to be removably joined to an intake end 54 of the second pick-up hose. In alternative embodiments of the present invention, the output coupler is adapted to be permanently joined to either or both of the second pick-up hose and the body of the wash-out apparatus, for example, using a glue or epoxy.

In the preferred embodiment of the present invention, the intake and output couplers are provided with threading (not shown) at their first and second ends end for screwing into complementarily threading in the flow valve, the body of the wash-out apparatus, and the first and second pick-up hoses. However, any other suitable means of attachment, such as ring clamps, can also be used.

In yet another embodiment of the present invention, the wash-out apparatus is incorporated as an integral part of a pick-up hose to form a unitary washout system. Alternatively, the wash-out apparatus can be configured to directly connect the wash-out apparatus to the pump assembly. Thus, the flow valve can be connected to the first pick-up hose and the output end of the body directly connected to the pump assembly. Similarly, the flow valve can be inserted directly into the liquid source pick-up point or container and the output end connected to the second pick-up hose.

The paint is transported from the wash-out apparatus through the second pick-up hose to the pump assembly (not shown). The wash-out apparatus according to the present invention is adapted for use with a pressurized airless pump.

Therefore, the input and output couplers 40, 42 are configured to provide an airtight connection with the first and second pick-up hoses 16*a,* 16*b,* respectively.

The flow valve 34 is used to control the fluid flow 35 between the liquid source pick-up point and the body. In the preferred embodiment of the present invention, the flow valve includes a ball valve 66. The flow valve is operable in a first open position (not shown) to permit paint from the first pick-up hose 16*a* to enter the body of the wash-out apparatus. In a second closed position (not shown), the flow valve is operable to seal the body of the wash-out apparatus from the flow of paint from the first pick-up hose.

The wash-out apparatus body also includes a wash-out hook-up 36 for controlling the fluid flow 37 between the body of the wash-out apparatus and the source of cleaning fluid. The wash-out hook-up is configured for connection to a source of cleaning fluid. In the preferred embodiment of the present invention, the wash-out hook-up is a standard faucet. In this embodiment, the standard faucet includes a screw-type wash-out hook-up valve 38 with a nozzle 60 configured for attachment to a garden hose. This valve and hose connection is used typically in water outlets for household and industrial applications. The connecting nozzle is generally one inch in diameter, and the garden hose diameters are generally ½ inch, ¾ inch, or 1 inch. In alternative embodiments of the present invention, the connector is adapted for connection to any other cleaning fluid assembly such as a canister, pressurized air cleaning system, and a pressurized hose (such as a fire hose assembly).

The wash-out hook-up valve can be varied according to system requirements. Thus, in the preferred embodiment of the invention, this valve is sized to ½ inch, ¾ inch, or 1 inch in diameter. However, the wash-out hook-up can also be provided in any other suitable shape or configuration.

One skilled in the art will appreciate that the body of the wash-out apparatus and all couplers and other components thereof must be made of suitable materials and of appropriate construction to withstand the pressure of the cleaning fluid received from the cleaning fluid assembly. In the presently preferred embodiment, the body of the wash-out apparatus is formed of polyvinyl chloride (PVC), steel, or brass. The thickness of the material used to form the body may be varied according to the total pressure which will be applied to the body by the pump and the various fluid flows. An example of typical pressures that are applied to the present invention is 60–90 psi.

Figure 3:
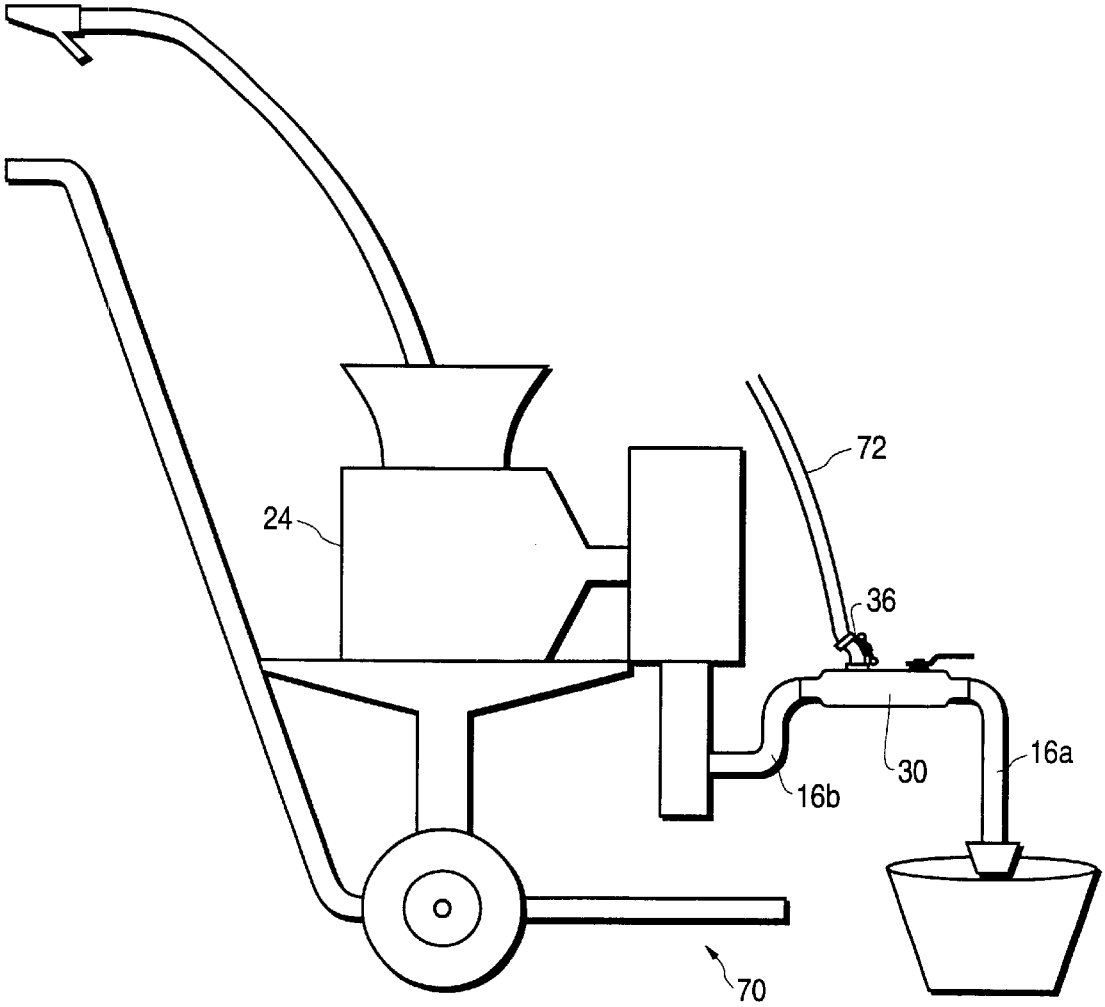
FIG. 3 illustrates a side view of an airless spray painting system, according to an embodiment of the present invention.

FIG. 3 is a side view of an airless spray painting system 70 according to the present invention. In the Figure, the wash-out apparatus 30 is shown connected between the first pick-up hose 16*a* and the second pick-up hose 16*b*. A cleaning fluid conduit 72 is shown connected to the wash-out hook-up. This cleaning fluid conduit can be connected at any stage of the painting process. Thus, the conduit can be connected before or during the painting process, with the wash-out hook-up valve kept in the second closed position to permit the paint to be transported to the spray gun. Alternatively, the cleaning fluid conduit can be connected to the wash-out hook-up immediately prior to the cleaning step.

The dimensions of the components of a preferred embodiment of the wash-out apparatus and the materials used for these components are listed in Table 1.

TABLE 1

| COMPONENT | MATERIALS | DIMENSIONS |
|---|---|---|
| Wash-out Body | Polyvinyl Chloride (PVC) Schedule D in thickness | Length: 2¾ inch<br>Diameter: ¾ inch inside diameter (ID) |
| Intake/Output Couplers | PVC | Length: 2½ inch<br>Diameter: ¾ inch ID |
| Wash-out Hook-up | Stainless Steel | Length: 1¾ inch<br>Diameter: ¾ inch ID |
| Wash-out Hook-up valve | Brass | Diameter: ¾ inch ID |
| Flow Valve | Stainless Steel | Length: 3¼ inch<br>Diameter: ¾ inch ID |
| Assembled Wash-out Apparatus | | Total Length: 9½ inches (approximately 1 inch of component lengths is lost when screwed/joined together) |

Figure 4:
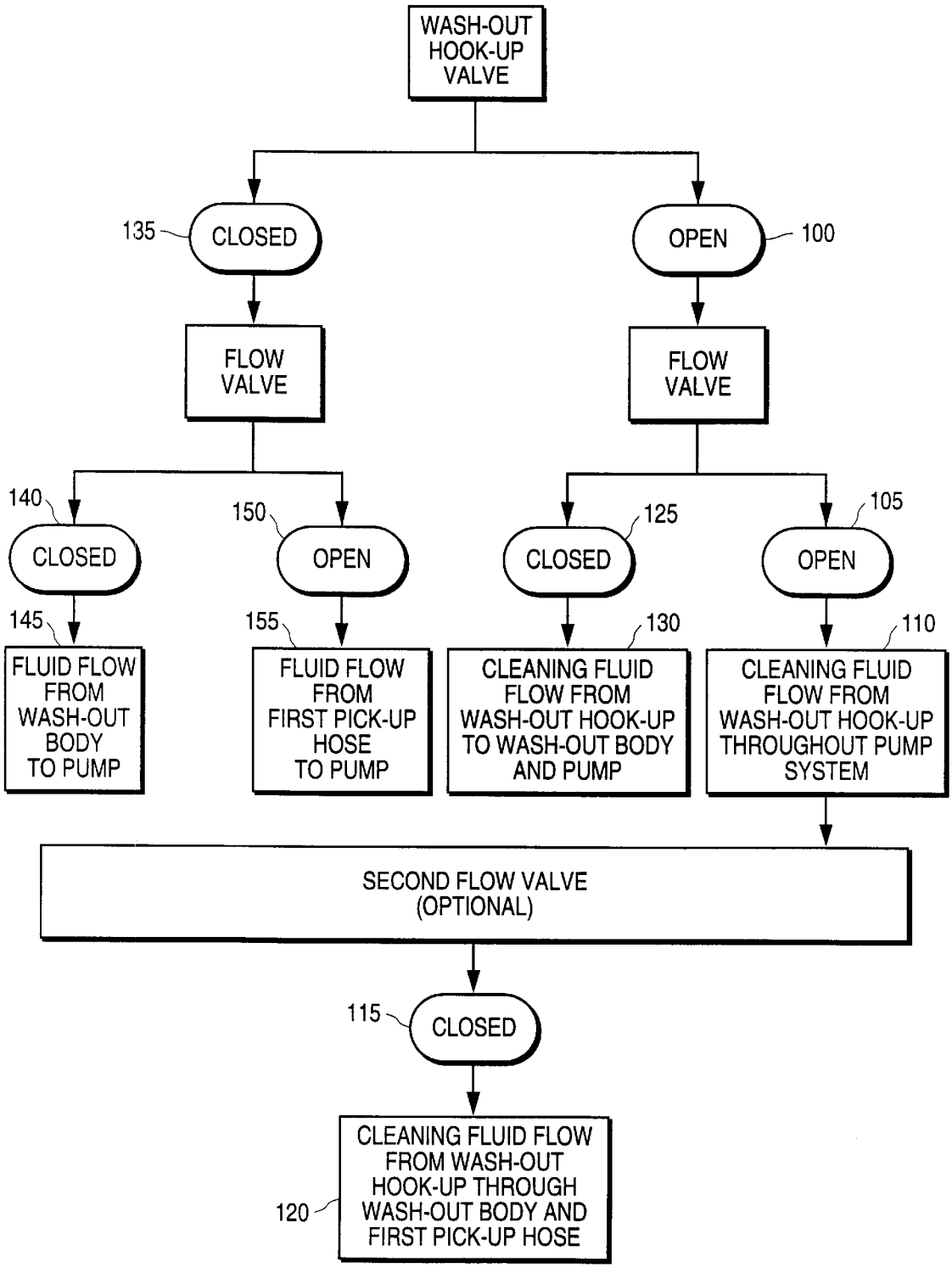
FIG. 4 illustrates a flow chart illustrating the operation of a fluid transfer pump wash-out apparatus, according to embodiments of the present invention.

FIG. 4 is a flow chart illustrating the operation of a fluid transfer pump wash-out apparatus according to the present invention. When the hook-up valve is in a first open position (100), and the flow valve is also in a first open position (105), the cleaning fluid from the wash-out hook-up enters the body of the wash-out apparatus and is directed throughout the entire fluid transfer pump system, including the wash-out apparatus, and both the first and second pick-up hoses (110). The cleaning fluid thereby cleanses the body, the pump assembly and spray gun, and the first pick-up hose. If the wash-out hook-up valve is in the first open position but the flow valve is in a second closed position (125), the cleaning fluid flow cannot enter the first pick-up hose. Therefore, in this configuration, the cleaning fluid from the wash-out hook-up will be directed through the body of the wash-out apparatus to cleanse the second pick-up hose, pump assembly, outlet hose, and spray gun (130).

In the alternative embodiment of the invention described with reference to FIG. 3, a second flow valve can be provided to control fluid flow between the body of the wash-out apparatus and the second pick-up hose. If this second flow valve is closed, fluid from the wash-out apparatus cannot enter the second pick-up hose. In addition, a closed second flow valve prevents the pumping force from the pump from affecting any fluids contained in the wash-out apparatus and connected wash-out hook-up and first pick-up hose. Therefore, if the wash-out hook-up valve and the flow valve are both in the first open position (100, 105) and the second flow valve is closed (115), the cleaning fluid from the wash-out hook-up will be directed from the wash-out hook-up through the body of the wash-out apparatus and the first pick-up hose (120).

When the hook-up valve is in a second closed position (135), the cleaning fluid from the wash-out hook-up is not permitted to enter the body of the wash-out apparatus. If the flow valve is in the first open position (150), paint from the first pick-up is permitted to enter the wash-out apparatus and is directed to the spray gun (155). However, if the flow valve is in the second closed position (140), the paint from the first pick-up hose is prevented from entering the second pick-up hose and the pump assembly. There is no fluid flow into the body of the wash-out apparatus. In this configuration, the pump can be used to draw any remaining fluid out of the body of the wash-out apparatus. Fluid is thereby prevented from accumulating within the body and the resulting contamination, particle deposition, and rusting of the body are thereby minimized.

While the invention is described in conjunction with the preferred embodiments, this description is not intended in any way as a limitation to the scope of the invention. Modifications, changes, and variations which are apparent to those skilled in the art can be made in the arrangement, operation and details of construction of the invention disclosed herein without departing from the spirit and scope of the invention.

The present invention can be provided as an integral part of a fluid transfer pump. Alternatively, in the preferred embodiment of the present invention, the fluid transfer pump wash-out apparatus is provided as a separate apparatus which can be removably attached to a fluid transfer pump as desired. For example, the present invention can be provided as a kit for use with a prior art fluid transfer pump.

The preferred embodiment of the present invention can therefore be configured for use with any suitable type of fluid transfer pump that uses standard threaded hose couplers. One skilled in the art will also readily recognize that the present invention can easily be adapted to fit non-standard threaded hose couplers or other types of attachment means. For example, the present invention can be joined to a fluid transfer pump by such means as a clamp, or a coupler. Sealing means such as gaskets or o-rings can optionally be provided at any or all attachments.

While the fluid transfer pump wash-out apparatus illustrated in FIG. 2 is cylindrical in shape, the present invention can be provided in any suitable shape, length or width. In the preferred embodiment of the present invention, the body of the wash-out apparatus is shaped as a rigid pipe having a diameter approximately equal to or slightly larger than the diameters of the first and second pick-up hoses. This embodiment is advantageous because the pressure of the fluid remains approximately constant as the fluid is transported from the first pick-up hose through the wash-out apparatus and to the second pick-up hose and a uniform fluid flow can be maintained throughout the fluid transfer pump system.

However, in alternative embodiments, the present invention can be formed in any suitable size, width, length, or shape. For example, the body of the wash-out apparatus can be formed as a receptacle or a holding tank. Additionally, the present invention can be made out of any appropriate material having a desired degree rigidity or flexibility. Thus, alternative embodiments of the present invention can be formed of materials such as metal, plastics, rubber, or out of combinations thereof. A wash-out apparatus according to the present invention can also be made from a length of flexible tubing or hose.

The present invention can use any suitable types of flow valve and/or hook-up valve, including but not limited to ball-check, control, gate, shut-off, or needle valves. The wash-out apparatus can be used with a timer, automated switching mechanisms, and/or control means. Thus, for example, the present invention can be adapted to automatically switch to a cleaning mode upon the passage of a certain amount of time.

The present invention has been described herein with respect to a fluid transfer pump or airless pump system that uses one liquid source pick-up point or container. However, the teachings of the present invention are equally applicable to fluid transfer pump systems that use a plurality of liquid source pick-up points. For example, the wash-out apparatus can have multiple pick-up couplings or multiple wash-out hook-ups. The present invention can thereby be used, for example, with a plurality of paint containers, or with several different sources of cleaning fluids or solvents. Control means can be provided to control the sources and amounts of the fluids supplied to the wash-out apparatus.

In one embodiment of the present invention, the wash-out apparatus body is configured as a fluid transfer manifold that can be used with a multiple-container fluid transfer system. While the following discussion is with respect to a wash-out apparatus body configured as a fluid manifold, the discussion is equally applicable to a wash-out apparatus body and separate fluid manifold adapted for use together with the airless spray pump system according to the present invention.

Figure 5A:
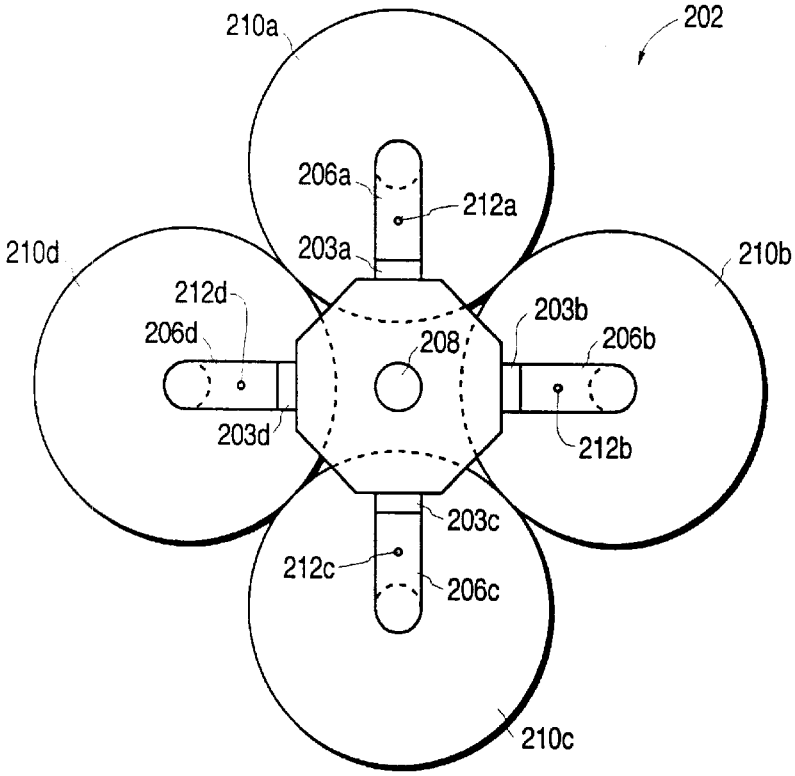
FIG. 5A illustrates a top view of a junction box, according to an embodiment of the present invention.
Figure 5B:
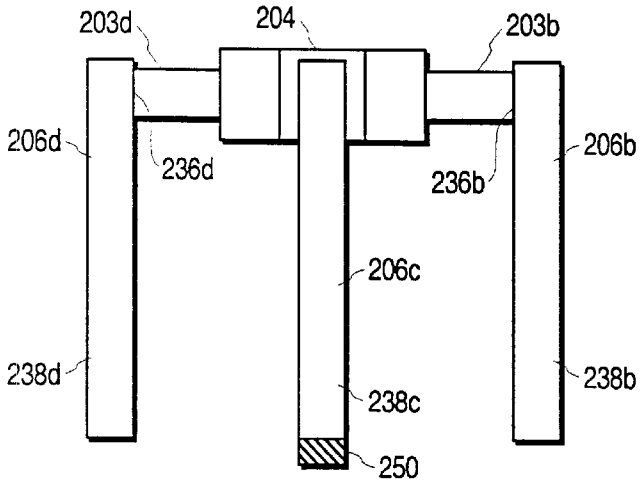
FIG. 5B illustrates a side view of the junction box illustrated in FIG. 5A, according to an embodiment of the present invention.

FIGS. 5A and 5B are top and side views, respectively, of a junction box according to the present invention. In this manifold embodiment 202, the wash-out apparatus body 204 is a junction box with a plurality of inlet couplers, and a common outlet coupler in fluid communication with the pump assembly. FIGS. 5A and 5B show four intake pick-up hoses. However, one skilled in the art will readily recognize that any number of pick-up hoses can be used in this embodiment of the present invention.

A plurality of pick-up hoses or feed pipes are connected to the junction box inlet couplers. Each output end 236*b, c, d* (236*a* is not shown) of the intake pick-up hoses 206*a, b, c, d* is adapted to be joined to a respective intake coupler 203*a, b, c, d* of the junction box, as described above with reference to FIG. 2. The action of the pump draws paint up from the pick-up point (fluid source), through the feed pipe and junction box, and out through the common output coupler to the pump assembly. The flow valve and wash-out hook up valve control the fluid flow to and from the body, as has been described above with reference to FIG. 2.

An input end 238*b, c, d* (238*a* is not shown) of each intake pick-up hose is inserted into a corresponding paint or liquid source 210*a, b, c, d*. A common outlet coupler 208 is adapted for coupling to an airless spray painting system pump (not shown), as has been described above with reference to FIGS. 2 through 4.

The junction box is preferably adapted to draw liquid substantially simultaneously from a plurality of different liquid source pick-up points to a common outlet. By "substantially simultaneously," it is meant that the manifold draws liquid evenly or approximately evenly from the different liquid sources to the common outlet. This is in contrast to drawing liquid from one source until the source is empty and then drawing liquid from a next source. However, in an alternative embodiment, liquid is drawn sequentially from a plurality of liquid sources.

The junction box can have any appropriate shape or number of different sides to accommodate any number of intake pick-up hoses. The junction box can be configured, for example, as an octagon to accommodate up to eight pick-up hoses. Alternatively, more than one intake pick-up hose can be accommodated on each side of the junction box. In yet another embodiment, the junction box has a curved exterior surface (not shown).

The intake pick-up hoses can be flexible, or can alternatively be formed of rigid or semi-rigid tubing. This tubing can take any appropriate shape to facilitate the supplying of fluid from the liquid source pick-up point. For example, the tubing can be curved, straight, or can have joints or bends. Different sizes and lengths of intake pick-up hoses can be used for liquid source pick-up points having different sizes or at varying distances from the junction box.

As shown in FIG. 5B, a filter 250 can be coupled, for example, to an input end 238*c* of an intake pick-up hose 206*c*. The filter can have any configuration well known in the art. For example, the filter can be made of a wire mesh in the shape of a cup secured to the end of the intake pick-up hose. Such filter can serve several purposes, including preventing debris from disrupting the spray gun and maintaining the input end of the pick-up hose a predetermined distance from the bottom of the paint source.

As has been described previously with reference to FIGS. 2 through 4, one or more valves 212*a, b, c, d* can be incorporated at any appropriate location(s) along the length of the intake pick-up hoses. Such valves can include but are not limited to ball valves and flow valves. Incorporating valves into the present invention allows the user control the flow from a particular paint source. The paint manifold will then draw paint evenly from the remaining open feed pipes. The valves can be used as described with respect to FIGS. 2 through 4 to permit the pump to draw fluid from a source, or to permit the supplying of cleaning fluid to any part of the pump system.

Figure 6A:
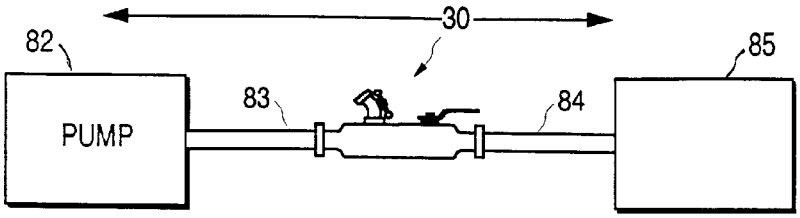
FIG. 6A illustrates the placement of the wash-out apparatus at locations between a junction box and the pump, according to one embodiment of the present invention.
Figure 6B:
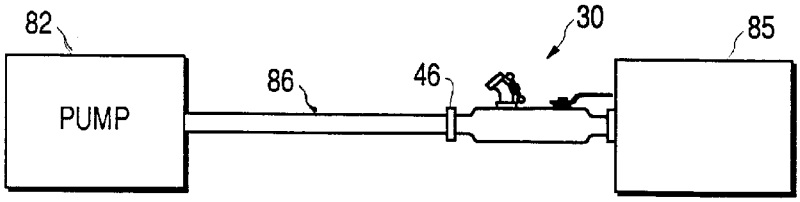
FIG. 6B illustrates the placement of the wash-out apparatus in association with a junction box, according to another embodiment of the present invention.
Figure 6C:
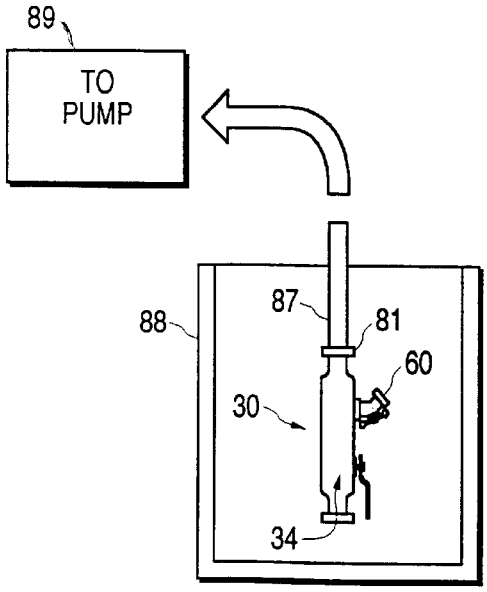
FIG. 6C illustrates the placement of the wash-out apparatus at the liquid source pick up point, according to embodiments of the present invention.

As stated above, the wash-out apparatus 30 is adapted for insertion anywhere between the liquid source pick-up point and the pump intake. FIGS. 6A through 6C illustrate several such embodiments wherein the wash-out apparatus 30 is positioned at various locations along the supply line, from a location between the pump and a junction box to a location at the liquid source pick-up point.

FIG. 6A illustrates the placement of the wash-out apparatus 30 at locations between a junction box 85 and the pump 82, according to embodiments of the present invention. In this illustrative embodiment, the wash-out apparatus 30 may be positioned in the supply line leading to the pump 82 such that it has some separation from the pump 82 and is in fluid communication with the pump 82 via a first hose 83 or other suitable fluid conduit, and such that it has some separation from the junction box 85 and is in fluid communication with the junction box 85 via a second hose 84 or other suitable fluid conduit. The wash-out apparatus 30 can be positioned anywhere along the supply line between the junction box 85 and the pump 82, such that the lengths of the first hose 83 and the second hose 84 are variable, as indicated by the two-directional arrow above the wash-out element 30 in FIG. 6A. Additionally, other system elements can also be present interspersed along the supply line without effect upon the wash-out apparatus arrangement and/or functionality; for example, the wash-out element 30 or hose 83 can be connected to any other intermediate system element before being in fluid communication with the pump 82. In a further embodiment, not shown, the wash-out element 30 can be in direct fluid communication with the pump 82, without the need for a hose or fluid conduit between them.

FIG. 6B illustrates the placement of the wash-out apparatus 30 in association with a junction box 85, according to one embodiment of the present invention. In this embodiment, the wash-out apparatus 30 is positioned in direct association with the junction box 85. The illustration of FIG. 6B shows the wash-out apparatus 30 directly attached to the output of the junction box 85, however the wash-out apparatus can also be integral with, located within, or in any other similar associative relationship with the junction box 85. An output end 46 of the wash-out apparatus 30 is connected to the pump 82 via a hose 86 or any other suitable fluid conduit, and, as with the embodiment of FIG. 6A, there can also be other system elements present along the fluid pathway without effect upon the present arrangement and/or functionality.

FIG. 6C illustrates the placement of the wash-out apparatus 30 at a liquid source pick up point 81, according to embodiments of the present invention. In this embodiment, the wash-out apparatus 30 is connected to the liquid source pick-up point 81 portion of a liquid source pick-up conduit 87; the liquid source pick-up point 81 and liquid source pick-up conduit 87 being the end of the liquid source supply line that is located within the supply container 88 (e.g., paint bucket). In the preferred implementation of this embodiment, the wash-out apparatus is attached when cleaning is desired, the source of cleaning is connected to the nozzle 60, and the flow valve 34 remains in the closed position. Cleaning fluid is then directed up the liquid source pick-up conduit 87 to pump 89 through system elements present in any embodiment of the present invention. For example, the wash-out element 30 of FIG. 6C could be attached to the first pick-up hose 16*a* of FIG. 3 or to any of the input ends 238 of the intake pick-up hoses 206 of the junction box structure illustrated in FIGS. 5A and 5B. In such arrangements, the closed flow valve 34 (indicated as optional at the bottom of FIG. 4) can be omitted from wash-out apparatus 30, for example, as disclosed in association with FIG. 2, by unthreading an output end 62 from the complimentary threading of the intake end 64 of the body, and replaced by a closed conduit section.

In the foregoing, systems, methods and apparatuses have been described for supplying fluid to a fluid transfer pump while facilitating the cleaning of the pump. Although the present invention has been described with reference to specific exemplary embodiments, it will be evident that various modifications and changes may be made to these embodiments without departing from the broader spirit and scope of the invention as set forth in the claims.

Accordingly, the specification and drawings are to be regarded in an illustrative rather than a restrictive sense.

What is claimed is:

1. An airless spray painting system comprising:

a housing comprised of a single fluid transfer pump, an intake, and an output coupler adapted to be connected to a paint supply line leading to a spray gun;

a wash-out element including:

a plurality of paint supply line couplers configured to be simultaneously coupled to a plurality of paint supply lines;

a body having:

(a) a pump output coupler integrally coupled to the fluid transfer pump;

(b) a wash-out coupler configured to be coupled to a cleaning fluid/supply line;

(c) a flow valve, actuable between an open position and a closed position, that controls a fluid flow between the body and the plurality of paint supply line couplers wherein when in the open position, the flow valve permits simultaneous fluid flow to the paint supply line couplers and, when the flow valve is in the closed position, the body is sealed from the paint supply line couplers; and (d) a wash-out valve, actuable between an open position and a closed position, that controls a fluid flow between the body and the washout coupler wherein, when the wash-out valve is in the open position, cleaning fluid can be directed through the pump and the wash-out coupler, and when the wash-out valve is in the closed position, the body is sealed from fluid flow from the wash-out coupler.

2. The airless spray painting system of claim 1, wherein the wash-out element is intergral with the housing.

3. The airless spray painting system of claim 1, wherein the body is intergral with the housing.

* * * * *